US006595223B2

(12) United States Patent
Wendt et al.

(10) Patent No.: US 6,595,223 B2
(45) Date of Patent: Jul. 22, 2003

(54) DEFLECTOR FOR RACK

(75) Inventors: Karl R. C. Wendt, Jackson, TN (US); Wayne M. Van Landingham, Jackson, TN (US)

(73) Assignee: Maytag Corporation, Newton, IA (US)

( * ) Notice: Subject to any disclaimer, the term of this patent is extended or adjusted under 35 U.S.C. 154(b) by 147 days.

(21) Appl. No.: 09/833,832

(22) Filed: Apr. 12, 2001

(65) Prior Publication Data

US 2002/0148493 A1 Oct. 17, 2002

(51) Int. Cl.[7] ..... B08B 3/02

(52) U.S. Cl. ..... 134/135; 134/182; 134/183; 134/201

(58) Field of Search ..... 134/56 D, 57 D, 134/58 D, 135, 201, 182, 183; D32/55; 211/41.1, 71; 220/97, 23.4; 312/311

(56) References Cited

U.S. PATENT DOCUMENTS

| | | | | |
|---|---|---|---|---|
| 1,254,287 | A | | 1/1918 | Sterling |
| 2,555,968 | A | * | 6/1951 | Harbison |
| 3,099,585 | A | * | 7/1963 | Kahn |
| 3,998,069 | A | * | 12/1976 | Kronenberger et al. |
| 4,527,707 | A | * | 7/1985 | Heymann et al. |
| 5,031,651 | A | * | 7/1991 | Spiegel et al. |
| D353,921 | S | | 12/1994 | Lippisch et al. |
| D398,725 | S | | 9/1998 | Merkel |

FOREIGN PATENT DOCUMENTS

| | | | |
|---|---|---|---|
| DE | 199 60 496 | * | 12/1999 |
| JP | 11-32848 | * | 7/1997 |

* cited by examiner

*Primary Examiner*—Frankie L. Stinson
(74) *Attorney, Agent, or Firm*—McKee, Voorhees & Sease, P.L.C.

(57) ABSTRACT

A shield or deflector for a dishwashing machine rack is disclosed. The deflector has a bottom wall and a front wall that permits food particles to be caught or deflected away from the floor when the rack extends beyond the door of the dishwashing machine when the door is in an open position. The deflector is removably or permanently mounted on the rack.

20 Claims, 3 Drawing Sheets

DEFLECTOR FOR RACK

TECHNICAL FIELD

The present invention relates generally to dishwasher racks, and more particularly to a shield or deflector for a rack in a washing machine which provides for the deflection of food particles and liquid to prevent the particles and liquid from falling on the floor when the rack is pulled out of the washing chamber.

BACKGROUND OF THE INVENTION

Dishwashers have long included slideable or rollable racks. In a typical front-loading dishwashing machine, the front door opens and one or more racks may be pulled from the interior of the dishwasher for loading and unloading purposes. In this conventional configuration, the racks pull out over the door. When plates, bowls, cups, glasses, and other serving ware or utensils are loaded in the dishwasher, the kitchen floor is protected from spillage of food material that may remain on the dirty dishes. In the conventional design, any food, including liquids, that falls through the rack, is captured by the open door. This configuration prevents leakage onto the floor.

There are problems with this conventional design. In particular, the door of the dishwashing machine must be long enough with respect to the racks to prevent food or liquid from falling to the floor. Thus, there is a problem in that dishwasher racks cannot extend further than the front edge of the open door. Thus, either the dishwasher racks are restricted in the amount that they slide, which causes loading difficulties, or a reduced size of rack must be used, or the size of the door and therefore the entire dishwashing machine must be large enough so that the racks cannot be pulled out further than the end of the door insert. Even if the door extends beyond the rack, particles or liquids may hit the door and then fall onto the floor.

It is therefore a general object of the present invention to provide a rack accessory that improves upon the state of the art.

A further object of the present invention is to provide a rack accessory that permits dishwashing machines to have shorter doors.

Another object of the present invention is to provide a rack accessory that permits racks to be extended further out of the interior of a dishwasher and beyond the open door for easier loading and unloading.

Yet another object of the present invention is to provide a dishwasher rack accessory that prevents food and liquid from dirtying the kitchen floor.

These and other objects will be apparent to those skilled in the art.

SUMMARY OF THE INVENTION

The rack accessory of the present invention is a shield or deflector for the rack of a dishwashing machine of the present invention includes a front wall and a bottom wall. The deflector is attached to the front of a dishwasher rack in order to prevent food and liquid from spilling out onto the floor when the rack is extended beyond the open door. Optionally, the deflector includes sidewalls that prevent additional spillage. The dishwasher rack accessory which is a deflector or shield permits for dishwashing doors to be shorter and/or for dishwashing racks to be extended further beyond the open door. The deflector also deflects food particles and liquid away from the edges of the open door so as to substantially preclude the food or liquid from hitting the door and then spilling onto the floor. Food falling from plates, bowls or other objects in the rack may also be caught by the deflector.

DESCRIPTION OF THE PREFERRED EMBODIMENT

Figure 1:
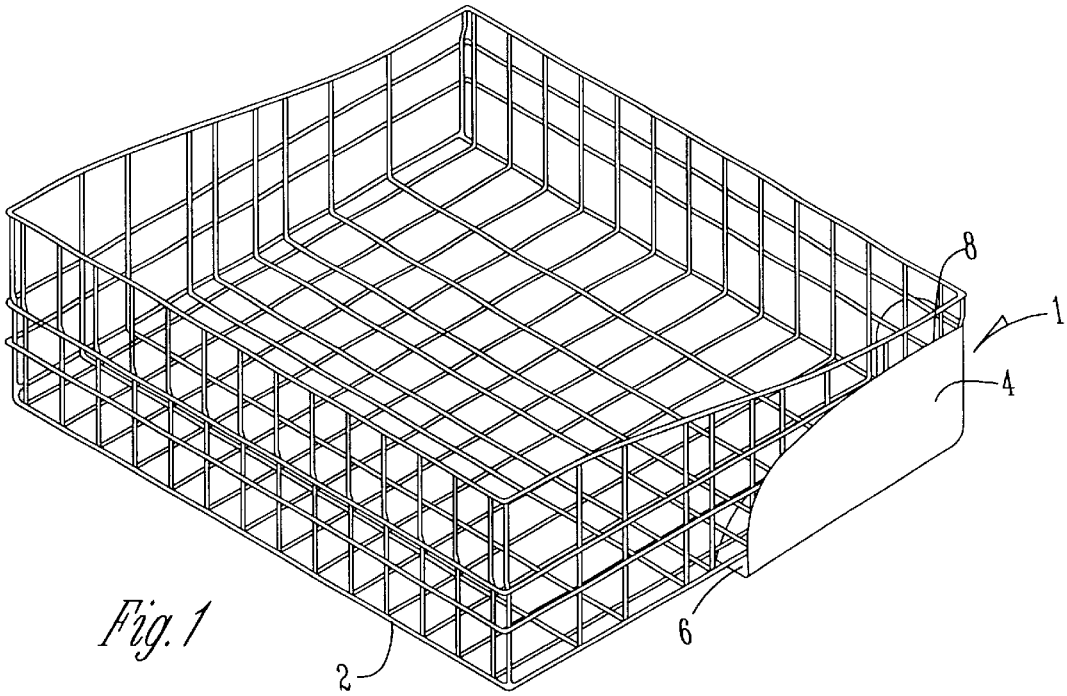
FIG. 1 is a perspective view of one embodiment of the deflector of the present invention mounted on a dishwashing rack.
Figure 2:
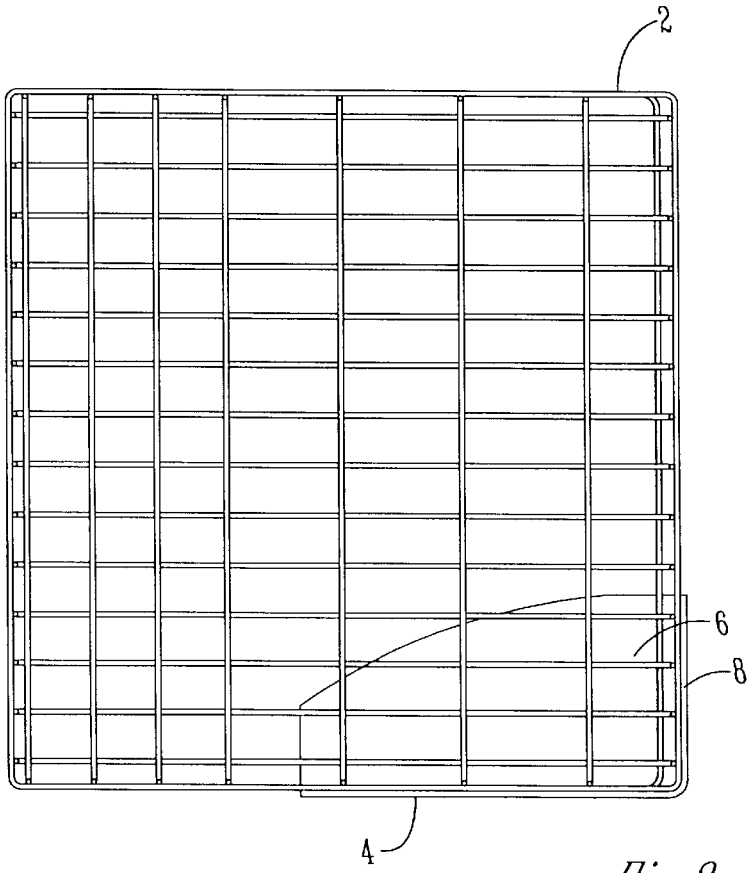
FIG. 2 is a top view of the deflector of FIG. 1.

A shield or deflector 1 for a dishwashing machine rack 2 is shown in a first embodiment in FIGS. 1 and 2. In a first embodiment, the deflector 1 includes a front wall 4, a bottom wall 6, and a sidewall 8. The 4, 6, 8 walls of the deflector 1 are integrally formed preferably of a plastic material. The deflector 1 may be snap fit, welded or otherwise permanently or removably attached to the dishwasher rack 2. As shown in FIGS. 1 and 2, the deflector 1 need only partially extend across the front of the rack 2.

Figure 3:
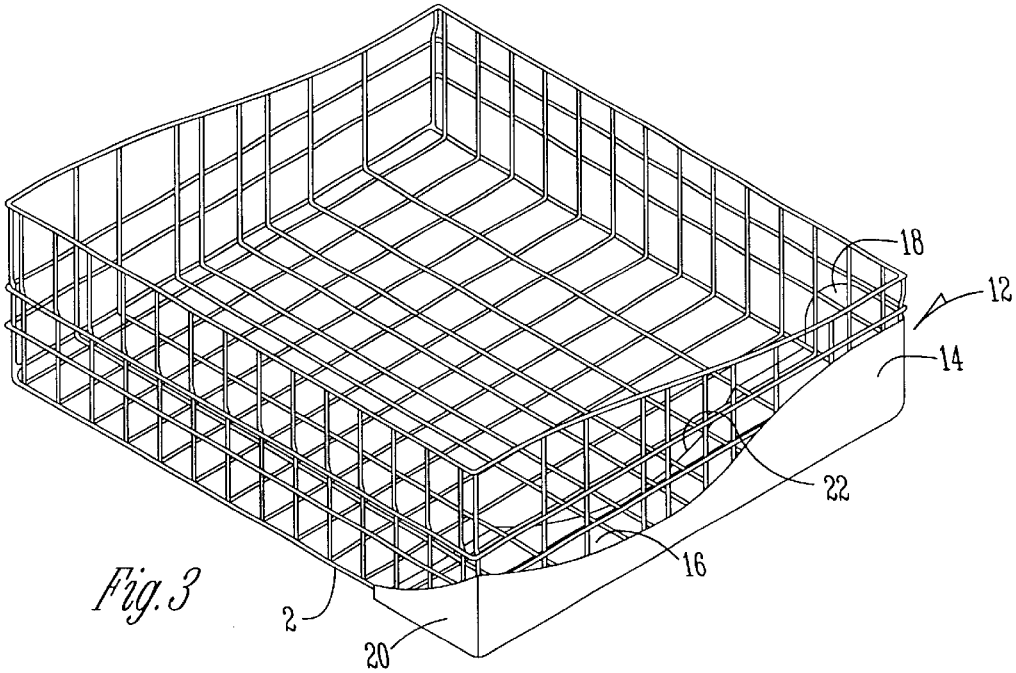
FIG. 3 is a perspective view of a second embodiment of the deflector.
Figure 4:
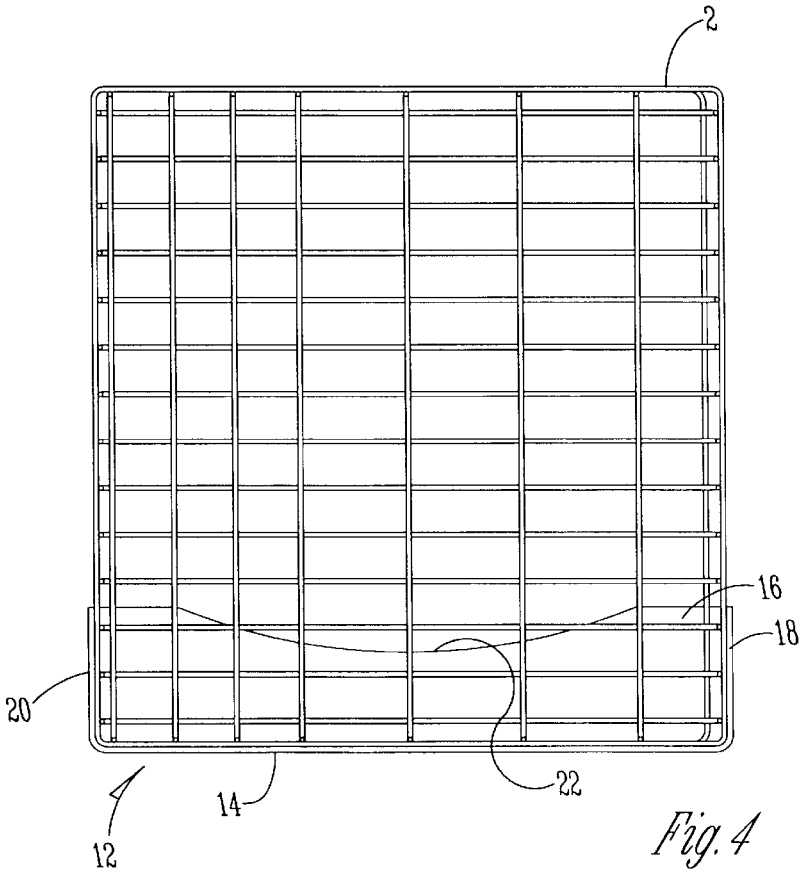
FIG. 4 is a top view of the second embodiment shown in FIG. 3.

The deflector of the present invention may also extend across the entire front of the rack 2, as best shown in FIGS. 3 and 4. In FIGS. 3 and 4, a second embodiment of the deflector 12 is shown. The deflector 12 has a front wall 14, a bottom wall 16, a first sidewall 18, and a second sidewall 20. The deflector 12 fits on the front of the rack 2 as shown. The deflector 12 may be snap fit, welded or permanently or removably secured to the rack 2 in any other convenient manner. The present invention contemplates that the portion 22 of the bottom wall 16 nearest the center of the rack 2 may be narrower as to allow for clearance of a washer arm (not shown), if necessary.

Figure 5:
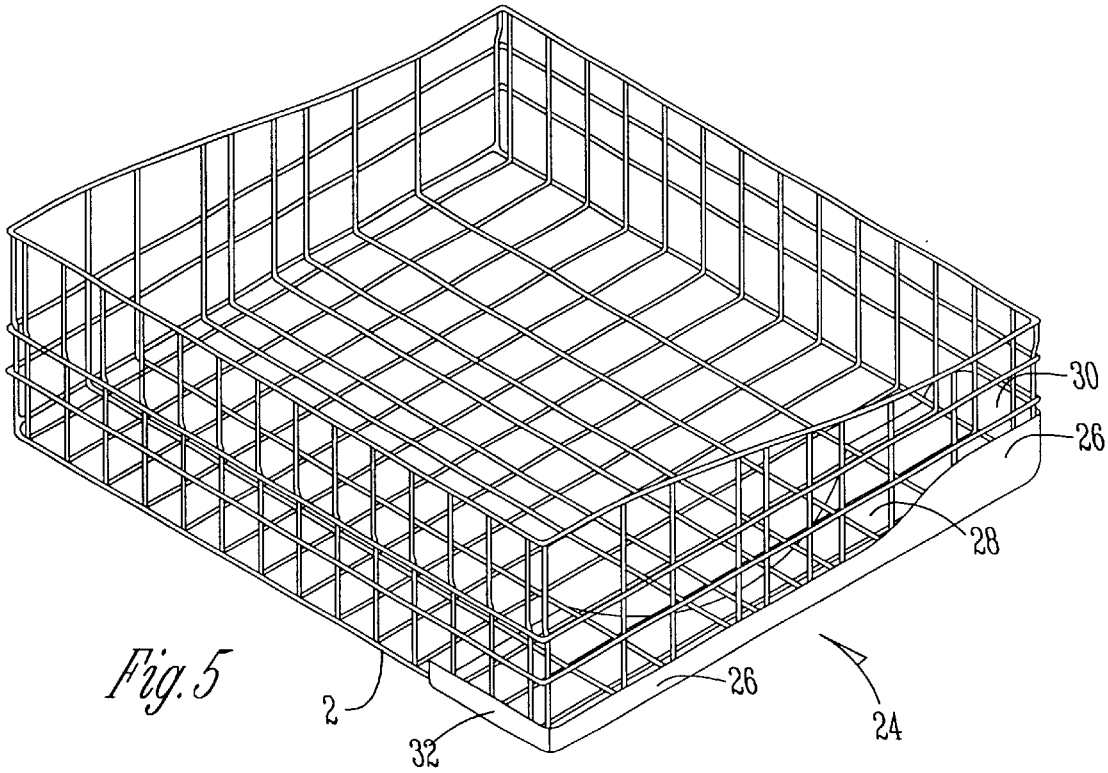
FIG. 5 is a perspective view of a third embodiment of the dishwasher rack deflector of the present invention.

FIG. 5 shows a third embodiment of a deflector 24. Deflector 24 has a front wall 26, a bottom wall 28, and side walls 30, 32. Deflector 24 may be attached to dishwasher rack 2 in the same manners as deflectors 1 and 12. The front wall 26 of the deflector 24 is a relatively shallow lip.

As a further alternative, the deflector of the present invention need not include sidewalls and may merely be a front wall and a bottom wall. The bottom wall of the deflector may also be sloped rearwardly to direct food particles or liquid toward the rear or lower edge of the dishwasher door when the door is open.

The present invention contemplates that the rack deflector itself may be made of a variety of different materials. These materials include, without limitation, polyethylene, high-density polyethylene, mylar, lexan, and other plastics or other materials. The rack deflector accessory is preferably snap fit onto any form of rack so as to be quickly and easily installed and removed. However, the present invention contemplates that other means of attachment may be used such as mechanically attaching the deflector such as through a screw or bolt, or bonding the deflector to the rack. Also, the deflector may be constructed of fine mesh so as to deflect or catch food particles, while permitting wash and rinse water to pass upwardly therethrough during operation of the dishwasher.

Thus, a deflector for a dishwasher rack has been described. As will be apparent to one skilled in the art, the present invention contemplates numerous variations. These variations include the number of walls of the deflector, the shape of the deflector, the material from which the deflector is made, the method of attachment of the deflector, and other options and variations.

What is claimed is:

1. A shield for a dishwasher having a door movable between open and closed positions, movable between a wash position within the dishwasher and a loading/unloading position, a rack capable of extending to a position wherein a portion of the rack extends over the opened door, the shield comprising:

a bottom wall;

a front wall attached to the bottom wall; and at least one of the walls being attachable to the rack, the walls capable of at least partially shielding the door from food material.

2. The shield of claim 1 wherein the rack has a width, the shield extending substantially the rack width.

3. The shield of claim 1 wherein the front wall is a lip.

4. The shield of claim 1 further comprising a first sidewall, the first sidewall attached to the bottom wall and the front wall.

5. The shield of claim 4 wherein the first sidewall is attached to the rack.

6. The shield of claim 4 further comprising a second sidewall, the second sidewall attached to the bottom wall and the front wall.

7. The shield of claim 6 wherein the second sidewall is attached to the rack.

8. The shield of claim 1 wherein the dishwasher has a wash arm, and the shield being contoured so as to provide for clearance for the wash arm.

9. The shield of claim 1 wherein the shield is a polyethylene shield.

10. The shield of claim 1 wherein the shield is a high density polyethylene shield.

11. The shield of claim 1 wherein the shield is mylar.

12. The shield of claim 1 wherein the shield is lexan.

13. The shield of claim 1 wherein the shield walls are of a mesh construction for catching food particles while allowing the passage of water.

14. A rack accessory for a dishwashing machine having a door and a having a rack capable of protruding so that a portion of the rack extends beyond the door when the door is in an open position, the rack accessory comprising:

a shield attached to the rack, a portion of the shield covering a portion of the bottom of the rack that extends beyond the door when the door is an open position and the rack is fully protruding, the shield obstructing food material falling from objects in the rack.

15. The rack accessory of claim 14 wherein the rack has a width, and the rack accessory has a width extending substantially the rack width.

16. The rack accessory of claim 14 wherein the dishwashing machine has a wash arm and the rack accessory further provides for clearance for the wash arm.

17. A deflector for a dishwashing machine rack, the deflector comprising:

a bottom wall for catching food material and liquids falling through the rack when the rack is extended beyond an open door of the dishwashing machine.

18. The deflector of claim 17 further comprising:

means for attaching the deflector to the rack.

19. The deflector of claim 17 further comprising:

means for providing clearance from a wash arm of the dishwashing machine.

20. A dishwasher rack comprising:

a front wall, a rear wall, opposite side walls, and a bottom wall;

a deflector mounted on the rack adjacent the front wall to catch food particles falling from objects loaded in the rack;

the deflector having a front wall and a bottom wall; and the deflector walls being a mesh construction for catching food particles while allowing the passage of water.

* * * * *